US006014990A

United States Patent [19]

Bamelis et al.

[11] Patent Number: 6,014,990

[45] Date of Patent: Jan. 18, 2000

[54] FILLING YARN STRETCHING DEVICE FOR A LOOM

[75] Inventors: Jean-Marie Bamelis; Chris Delanote; Jozef Peeters, all of Ypres, Belgium

[73] Assignee: Picanol N.V., Ypres, Belgium

[21] Appl. No.: 09/043,573

[22] PCT Filed: Oct. 1, 1996

[86] PCT No.: PCT/EP96/04282

§ 371 Date: Apr. 2, 1998

§ 102(e) Date: Apr. 2, 1998

[87] PCT Pub. No.: WO97/13017

PCT Pub. Date: Apr. 10, 1997

[30] Foreign Application Priority Data

Oct. 2, 1995 [BE] Belgium ..... 9500814

[51] Int. Cl.[7] ..... D03D 47/30

[52] U.S. Cl. ..... 139/194; 139/116.1

[58] Field of Search ..... 139/194, 116.1

[56] References Cited

U.S. PATENT DOCUMENTS

| | | | |
|---|---|---|---|
| 4,936,353 | 6/1990 | Volland et al. | 139/194 |
| 4,976,292 | 12/1990 | Matsumoto | 139/194 |
| 5,091,246 | 2/1992 | Yasui et al. | 139/387 R |
| 5,226,458 | 7/1993 | Bamelis | 139/194 |
| 5,606,998 | 3/1997 | Wahhoud et al. | 139/194 |
| 5,735,316 | 4/1998 | Hehle | 139/194 |

*Primary Examiner*—Andy Falik

*Attorney, Agent, or Firm*—Bacon & Thomas, PLLC

[57] ABSTRACT

A device for stretching an inserted filling (14), in particular for use in an airjet loom, includes a channel (5) adjoining a filling insertion conduit (4) of a reed (3), a blow nozzle directed at a branch channel intersecting the channel (5) in substantially perpendicular manner discharging into the channel (5), and at least one deflection location for the filling (14). The deflection location consists of a wear-resistant element (7, 10, 11) that extends substantially transversely to the direction of insertion (A) of the filling.

9 Claims, 1 Drawing Sheet

FILLING YARN STRETCHING DEVICE FOR A LOOM

BACKGROUND OF THE INVENTION a) Field of the Invention

The invention relates to a device for stretching an inserted filling-yarn, in particular for an airjet loom, and comprising a channel adjoining a filling-yarn insertion-conduit of a reed, a blow nozzle discharging into said channel and pointing to a branch channel which intersects in substantially a perpendicular manner said channel and which comprises at least one filling-yarn deflecting location.

b) Related Technology

As regards airjet looms, a device to stretch the inserted filling yarn (here-after filling) is mounted at the end of the filling insertion conduit formed by a plurality of reed lamellas in order to prevent the filling from recoiling after being inserted. Such devices are fitted with a channel running as a straight extension of the filling insertion conduit, a blow nozzle issuing into said channel and pointing at a branch channel intersecting substantially perpendicularly into the channel. A deflection location is located at the inlet of the said branch channel which also can be made to return to the channel along a curved path (EP 0 493 847 A1).

The objective of the invention is to improve a device of the above kind.

This problem is solved in that the at least one deflection location consists of a wear-resistant element mounted substantially transversely to the filling's direction of insertion.

BRIEF SUMMARY OF THE INVENTION

The invention is based on the consideration that the deflection location(s) are subject to wear caused by the filling running over it (them), whereby, after a given time of operation, the effect of the device will change and possibly the filling entering the device and held in it will be damaged. Because of the wear-resistant element(s) at the deflection location(s), constant and proper operation is assured by the said element(s) at the deflection location(s) and at the same time the danger of damaging the fillings is reduced.

In a preferred embodiment of the invention, the branch channel follows a curved path and joins again the channel. Two wear-resistant elements, each forming a deflection site for the filling, are mounted at the inlet of the branch channel. In this embodiment the filling's friction at the deflection locations and the applied pneumatic forces oppose filling-recoil, whereby the extant conditions also are preserved over a substantial length of operation because the deflection locations are wear-resistant elements and thereby do not incur any significant wear even over lengthy operation.

DESCRIPTION OF THE DRAWINGS

Further advantages and features of the invention are elucidated in the following description of the embodiment schematically shown in the drawing.

DETAILED DESCRIPTION

Figure 2:
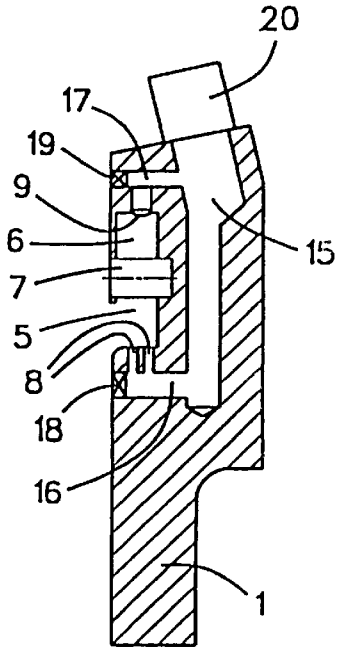
FIG. 2 is a cross-section of the stretching device approximately along line II—II of FIG. 1.

The stretching device 1 is mounted together with a reed 3 on a batten 2. The reed 3 consists of a plurality of lamellas forming a unilaterally open U-shaped filling insertion conduit 4.

The stretching device 1 comprises a housing fitted with a main filling yarn receiving channel 5 directly adjoining the exit end of the filling insertion conduit 4 of the reed 3, said housing also having a U-shaped cross-section substantially corresponding to the filling insertion conduit 4 and running along the insertion direction A from its inlet as an extension of the filling insertion conduit 4.

A branch channel 6 intersects the channel 5 directly behind its inlet and the first segment of said branch channel runs approximately perpendicularly to the channel 5 away from the batten 2 and then merges at an approximately cylindrical curvature to and intersecting a second segment returning into the channel 5. A first blow nozzle 8 discharges towards the inlet orifice of the branch channel 6 and also discharges into the lower side 13 of said channel 5 somewhat offset from the insertion conduit 4 and towards the batten 2. The blowing-in of the arriving filling is facilitated because of this offset configuration. The branch channel 6 is separated by a partition defining a filling yarn guide from the channel 5, said yarn guide being cross-sectionally pear- or droplet-shaped. Towards the inlet of the branch channel 6, the yarn guide comprises a wear-resistant element 7 of cylindrical structure and forms an apical deflection for a filling 14. Said wear-resistant element 7 is mounted substantially transversely to the direction of insertion A of the filling 14 and is adjoined by a support element 12 which may be part of the housing or a separate part. A wear-resistant element 11 is located at the outlet of the branch channel 6 on the side facing the channel 5. The support element 12 is configured to be recessed from the a straight line connecting the peripheries of wear-resistant elements 7 and 11 engaged by the filling 14. Consequently the support element 12 does not touch the filling and hence cannot damage it even if burred. The two wear-resistant elements 7 and 11 run substantially transversely to the blow-direction of the blow nozzle 8 and comprise convex surfaces.

Another blow nozzle 9 is located approximately above the apex line of the wear-resistant element allowing the filling 14 to loop around by an angle of about 90°. The blow nozzle 9 essentially runs toward the second segment of the branch channel 6 returning to the channel 5. The air jet issuing from the blow nozzle 9 ensures that the filling 14 shall reliably rest against the wear-resistant element 7 and also against the wear-resistant element 11. Although the blow nozzle 8 comprises two or more small blow orifices delivering compressed air with well directed jets, the blow nozzle 9 comprises only one more substantial blow aperture.

Figure 3:
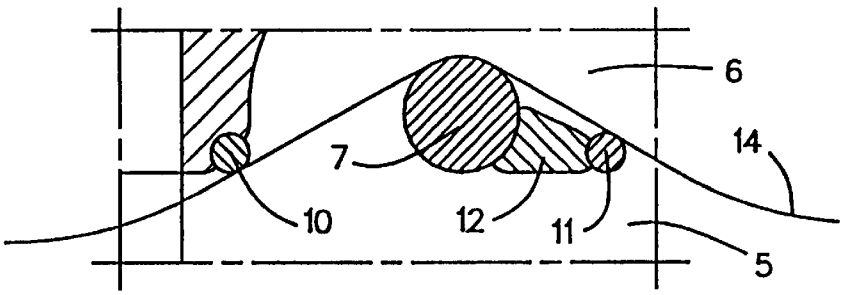
FIG. 3 is an enlarged detail F3 of FIG. 1.

As shown in particular in FIG. 3, another wear-resistant element 10 is mounted in the vicinity of the front edge of the inlet of the branch channel 6 and runs essentially transversely to the direction of insertion A of the filling 14 while forming a first deflection area for the filling 14. The sizing, that is the diameter of this element 10, is comparatively small in order that the inlet to the branch channel 6 can be placed as close as possible to the filling insertion conduit 4.

The cross-section or curvature of the wear-resistant element 7 essentially corresponds to that of the branch channel 6 and consequently the yarn rests along a comparatively long path against the wear-resistant element 7. In a variation of the shown embodiment, the wear-resistant elements 7 and 11 as well as the support element 12 are one integral component having a pear- or droplet-shaped cross-section.

As shown by FIG. 2, a fitting 20 is present at the housing of the device 1 to affix a compressed-air supply line. Supply conduits 15, 16 and 17 made in the housing lead from said fitting to the blow nozzles 8 and 9. The housing may be made for instance by injection molding, the shapes of the channel 5 and of the branch channel 6 as well as of the blow nozzles 8 and 9 and of the supply conduits 15, 16 and 17 being implemented during injection molding. In another design, only the housing's exterior is injection molded, the channel 5 and the branch channel 6 being milled. The supply conduits 15, 16 and 17 as well as the blow nozzles 8, 9 then are in the form of boreholes, the supply conduits 16 and 17 being sealed by stoppers 18 and 19.

The wear-resistant elements 7, 10 and 11 form the deflection locations for a filling 14 and comprise rounded peripheral rest surfaces for this filling. Preferably they are cylindrical, being easily manufactured and installed. Being wear-resistant, their wear is comparatively slight, and the danger of damaging the yarn end of a filling 14 is thus reduced. The wear-resistant elements 7, 10 and 11 are made of ceramic in a first embodiment. In another embodiment they are basically made of metal or plastic and fitted with a peripheral coating.

Figure 1:
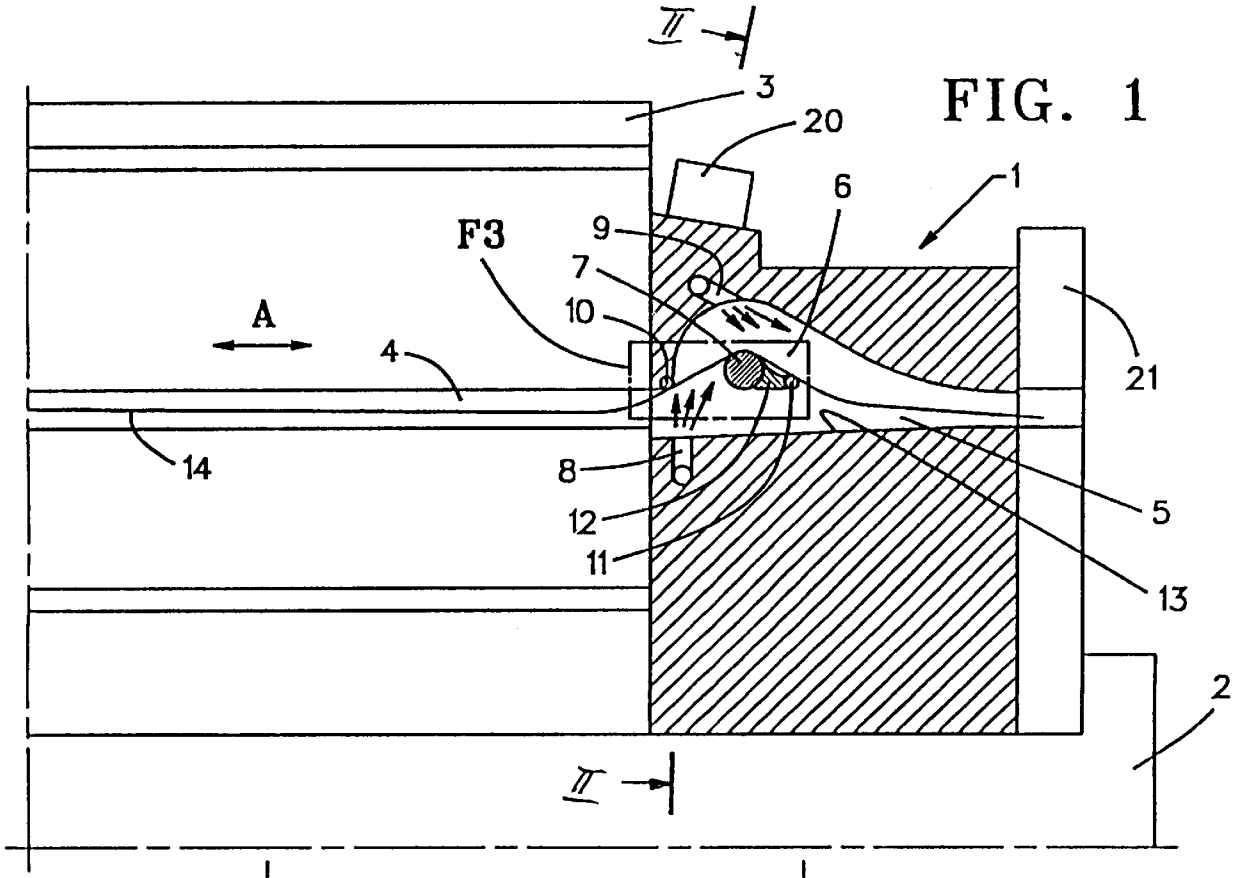
FIG. 1 is a partial view of an airjet loom with a section of a stretching device of the invention.

As seen in FIG. 1, a detector 21 is mounted in the extension and at the outlet end of the channel 5, a filling 14 being blown into said detector. Illustratively, it is possible using this detector 21, which may be affixed also to the batten 2, to identify an excessively long filling 14.

In the device for stretching the filling 14, which in known manner is blown by main blow nozzles and inserting nozzles through the filling insertion conduit 4 of the reed 3, the filling 14 will first be deflected by the blow nozzle 8 around the wear-resistant element 7 and then by the further blow nozzle 9 around the wear-resistant element 7. Recoil of the filling 14 following filling insertion is precluded because of the air jet blown out of the blow nozzles 8 and 9 and because of the friction of the filling 14 especially at the wear-resistant element 7 and also at the wear-resistant element 10.

The scope of protection of the device of the invention is not restricted to the above embodiment but instead is determined by the attached claims. In particular variations in shape and/or configuration of the wear-resistant elements 7, 10 and 11 as well as in the geometry of the branch channel 6 are possible.

We claim:

1. In an airjet loom including a reed (3); a filling yarn insertion conduit (4) associated with the reed and extending along a filling yarn insertion direction (A), a main filling yarn receiving channel (5) having an inlet located adjacent an exit end of the conduit and arranged to receive a filling yarn moving along an insertion direction; a branch channel (6) in communication with and located adjacent one side of the main channel (5); a first blow nozzle (8) located adjacent the inlet of the main channel and discharging into the main channel in a direction transversely of the main channel and towards the branch channel; and a filling yarn deflection location within the branch channel downstream of said blow nozzle; the improvement comprising:

at least one wear resistant element (7, 10, 11) disposed in said branch channel at said yarn deflection location and extending transversely to the insertion direction of the filling yarn (14);

said branch channel (6) extending from a branch channel inlet adjacent the main channel inlet along a curved path leading away from and then back to the main channel;

said at least one wear resistant element being mounted at the inlet end of the branch channel.

2. The improvement as claimed in claim 1, wherein said at least one wear resistant element comprises a separation partition defining a filling yarn guide located between the branch channel and the main channel.

3. The improvement as claimed in claim 2, wherein the at least one wear resistant element defines an apical guide for the filling yarn.

4. The improvement as claimed in claim 3, wherein said filling yarn guide includes a support element comprising said separation partition; said at least one wear resistant element including two wear resistant elements separated along the branch channel length, said support element extending between the wear resistant elements and offset away from a straight line extending between the wear resistant elements towards a side of the branch channel adjacent the wear resistant elements.

5. The improvement as claimed in claim 3, wherein said wear resistant element is cylindrical and has a cross-section curvature corresponding to the curvature of the branch channel.

6. The improvement as claimed in claim 1, including a second blow nozzle (9) discharging into the branch channel (6) adjacent the inlet of the branch channel and in a direction towards the location where the branch channel intersects the main channel.

7. The improvement as claimed in claim 1, wherein said branch channel and main channel are integrated in a singular housing; a compressed air supply connector connected to the housing; and said first air supply conduit in the housing connecting the air supply connector to at least one blow nozzle.

8. The improvement as claimed in claim 1, wherein said at least one wear resistant element is made of a ceramic material and includes an approximately cylindrical periphery that engages a filling yarn supplied to the branch channel.

9. The improvement according to claim 1, wherein said at least one wear resistant element includes a curved peripheral surface intended to engage a filling yarn supplied to said branch channel, and wherein said peripheral surface comprises a wear-resistant coating.

* * * * *